US010170239B2

(12) United States Patent
Steinhilber

(10) Patent No.: US 10,170,239 B2
(45) Date of Patent: Jan. 1, 2019

(54) MAGNETIC COIL MANUFACTURING

(71) Applicant: Rolf Prettl, Tuebingen (DE)

(72) Inventor: Jens Steinhilber, Hechingen (DE)

(73) Assignee: ROLF PRETTL, Tuebeingen (DE)

( * ) Notice: Subject to any disclaimer, the term of this patent is extended or adjusted under 35 U.S.C. 154(b) by 280 days.

(21) Appl. No.: 15/095,499

(22) Filed: Apr. 11, 2016

(65) Prior Publication Data

US 2016/0298582 A1 Oct. 13, 2016

(30) Foreign Application Priority Data

Apr. 13, 2015 (DE) ..... 10 2015 105 591

(51) Int. Cl.

| | |
|---|---|
| ***H01F 41/02*** | (2006.01) |
| ***H01F 41/098*** | (2016.01) |
| ***H01F 41/12*** | (2006.01) |
| ***H01F 7/127*** | (2006.01) |
| ***H01F 7/128*** | (2006.01) |
| ***F02M 51/06*** | (2006.01) |
| ***H01F 5/02*** | (2006.01) |
| ***H01F 41/04*** | (2006.01) |

(52) U.S. Cl.

CPC ..... *H01F 41/0206* (2013.01); *F02M 51/061* (2013.01); *H01F 5/02* (2013.01); *H01F 7/127* (2013.01); *H01F 7/128* (2013.01); *H01F 41/04* (2013.01); *H01F 41/098* (2016.01); *H01F 41/127* (2013.01); *Y10T 29/4902* (2015.01); *Y10T 29/49073* (2015.01)

(58) Field of Classification Search

CPC .... H01F 41/0206; H01F 41/04; H01F 41/098; H01F 41/127; H01F 5/02; H01F 7/127; H01F 7/128; F02M 51/061; Y10T 29/4902; Y10T 29/49073

See application file for complete search history.

(56) References Cited

U.S. PATENT DOCUMENTS

| | | | |
|---|---|---|---|
| 4,575,008 | A | 3/1986 | Kaczynski |
| 6,371,270 | B1 | 4/2002 | Matsumoto |

(Continued)

FOREIGN PATENT DOCUMENTS

| | | | |
|---|---|---|---|
| DE | 10032328 | A1 | 3/2001 |
| DE | 10151955 | A1 | 5/2003 |

(Continued)

*Primary Examiner* — A. Dexter Tugbang

(74) *Attorney, Agent, or Firm* — Jason H. Vick; Sheridan Ross, PC

(57) ABSTRACT

One aspect is for a method of manufacturing a magnetic coil for a magnetic actuator. A coil carrier is provided which comprises a tubular section and a collar which adjoins the tubular section, wherein the coil carrier is arranged for accommodating a coil winding. A die comprising a defined inner contour is provided which is adapted to the coil carrier. The coil carrier is inserted into the die, wherein the collar of the coil carrier rests on a seating surface of the die. The collar is punched with a punch, wherein a flange contour is formed at the collar the outline of which is defined by an inner contour of the die. The coil carrier is also at least sectionally potted or overmolded with a filler material, wherein the flange contour provides a barrier for the filler material. The disclosure further relates to a corresponding magnetic coil.

16 Claims, 6 Drawing Sheets

(56) References Cited

U.S. PATENT DOCUMENTS

| | | | | |
|---|---|---|---|---|
| 2004/0090294 | A1 | 5/2004 | Just et al. | |
| 2005/0232803 | A1 | 10/2005 | Kuttler et al. | |
| 2009/0250836 | A1* | 10/2009 | Fukui | H01F 41/127 264/272.15 |
| 2011/0115330 | A1 | 5/2011 | York et al. | |
| 2011/0128103 | A1* | 6/2011 | Baba | H01F 7/128 335/260 |

FOREIGN PATENT DOCUMENTS

| | | | | |
|---|---|---|---|---|
| DE | 102004008450 | A1 | | 9/2005 |
| EP | 0132623 | A2 | | 2/1985 |
| JP | 59103308 | A | * | 6/1984 |
| JP | 08250357 | A | * | 9/1996 |
| JP | 2012-174903 | | | 9/2012 |

* cited by examiner

MAGNETIC COIL MANUFACTURING

CROSS-REFERENCES TO RELATED APPLICATIONS

This application claims priority from German patent application 10 2015 105 591.0, filed on Apr. 13, 2015. The entire content of that priority application is fully incorporated by reference herewith.

BACKGROUND

The present disclosure relates to a method for manufacturing a magnetic coil for a magnetic actuator, particularly for an injector. The disclosure further relates to a magnetic coil for a magnetic actuator and to an injector, particularly a fuel injector nozzle for a combustion engine, comprising such a magnetic actuator.

A common fuel injector nozzle is for instance known from EP 0 132 623 A2. The injector nozzle is provided with a magnetic actuator comprising an induction coil which is encapsulated and arranged in a fashion fixed to a housing.

Injectors for the fuel supply for combustion engines are generally known. Injectors of that kind are also referred to as injector nozzles. Modern injectors are provided with mechatronical actors, for instance with magnetic actuators, so as to control the opening and closing of the nozzles in a high-precision fashion. Modern injection systems for diesel engines are configured for maximum injection pressures of several hundred bars up to more than 1000 bar or even up to 2500 bar.

Injectors comprising so-called piezo-actuators are known. Nevertheless, also injectors comprising magnetic actuators are widely used. Injectors of that kind are commonly provided with a magnetic coil which cooperates with a movable armature for controlling the injector.

Actuators for injector nozzles must be manufactured in a high-precision fashion so as to be able to provide a respectively desired injection volume in a repeatedly accurate manner. Accordingly, there are frequently very tight tolerance specifications for the production. Further, it must be noted that the utilized components of the injector have to be considerably fuel-resistant or propellant-resistant so as to be resistant to the fuel which flows through the injector. The fuel may for instance involve diesel fuel, gasoline fuel, ethanol, light oil, heavy oil, kerosene or mixtures thereof.

The frequency at which the actuators of the injectors are controlled typically corresponds to the speed of rotation of the combustion engine. However, there are also injectors known that enable a plurality of injections event in a single combustion cycle. This may involve a further increased load to the injector and to the actuator thereof. Further, injectors are regularly fixedly attached to a cylinder head or a similar housing component of the combustion engine. This involves that the injector and the components provided therein are exposed to heavy vibration exposures, temperature variations and similar environmental impacts. Accordingly, there is a general need to design injectors in a robust fashion so as to ensure a specified minimum lifespan (for instance defined by operating cycles and such like).

For injectors that utilize magnetic actuators, it is a common measure to at least sectionally overmold and/or pot a coil winding of the magnetic coil of the actuator. In this way, the sensitive coil winding may be protected against environmental influences. Generally, such a magnetic coil comprises a coil body made from plastic material which supports a copper winding. For instance, the coil carrier that is provided with the coil winding is arranged in a magnet pot which defines a yoke of the magnetic actuator. By sealing, potting or overmolding the coil carrier that is received at or in the magnet pot, the coil winding is at least sectionally overmolded and/or potted with a (temporarily) fluid filler material.

The armature of such a magnetic actuator which cooperates with the magnet pot and the coil winding is frequently arranged as a plate armature and/or in a similar fashion. A lifting distance of the armature is frequently in a range of a few hundredths of a millimeter up to about 0.1 mm. As a result, even deviations in the range of a few micrometers at the seating surface and/or the abutment surface of the armature have a great influence on the function of the injector. A design goal may therefore involve to avoid, as much as possible, deviations of the armature stroke that is defined by the design.

It has been observed that the required potting and/or the required overmolding of the coil winding may in this respect have a negative impact. Generally, the overmolding and/or potting of the coil winding is performed in connection with the magnet pot, that is, in a state when the coil carrier that is provided with the coil winding is already arranged at the magnet pot in the desired final position. This involves that a molding form and/or potting form for such a procedure has to cooperate with the magnet pot in a high-precision fashion so as to ensure a sufficient sealing. If this is not the case, excess molding material (flash material) may be formed which involves events wherein the filler material (molding compound or potting compound) enters regions which actually shall not be entered for design and/or functional reasons. Even though there exist established solutions for avoiding such excess molding material, these solutions always involve increased production efforts. For instance, the tool which is used for overmolding or potting may be manufactured at an increased accuracy, and the magnet pot which cooperates with the tool may be also provided with an increased precision in a portion thereof that is arranged for contacting such a tool. However, this involves an increased production effort and also an increased wear on the side of the tool.

By contrast, in cases where no complete sealing of the magnet pot by the injection molding or potting tool may be ensured, excess molding material (flash material) may be present. Hence, in these cases, an increased scrap/waste or functional deficiencies have to be expected. Excess molding material may be generally referred to as residual flash.

In view of this, it is a first object of the present disclosure to provide a method for manufacturing a magnetic coil for a magnetic actuator which results in an improved quality of the potting and/or molding.

It is a further object to provide a method for manufacturing a magnetic coil for a magnetic actuator which involves an improved reproducibility and process reliability.

It is a further object to provide a method for manufacturing a magnetic coil for a magnetic actuator which prevents excess flash molding material to a great extent or even entirely.

More particularly, it is a further object to provide a method for manufacturing a magnetic coil for a magnetic actuator, wherein residual flash of the filler material at functional surfaces, particularly at contact surfaces or seating surfaces for the armature may be avoided to a considerable extent.

It is a further object to provide a method for manufacturing a magnetic coil for a magnetic actuator that is arranged to utilize robust tools/molds for the potting or overmolding which may achieve a great service life and/or lifespan.

It is a further object to provide a method for manufacturing a magnetic coil for a magnetic actuator that enables a reduction of efforts for quality management and a reduction of scrap production.

It is a further object to provide a method for manufacturing a magnetic coil for a magnetic actuator that enables the production of injectors which provide an increased operation performance and which are arranged to be controlled in a highly-accurate fashion.

It is a further object to present exemplary arrangements of magnetic coils and of injectors that are provided with respective magnetic coils that may profit from exemplary embodiments and aspects of the manufacturing method.

SUMMARY

In regard of the manufacturing method, these and other objects of the present disclosure are achieved by a method of manufacturing a magnetic coil for a magnetic actuator, the method comprising the following steps:

- providing a coil carrier comprising a tubular section and a collar, wherein the coil carrier is arranged for accommodating a coil winding,
- providing a magnet pot comprising a defined inner contour which is adapted to the coil carrier,
- inserting the coil carrier in the magnet pot, wherein the collar of the coil carrier rests on a seating surface of the magnet pot,
- punching the collar with a punch that cooperates with the magnet pot, wherein, at the collar, a flange contour is formed an outline of which is defined by the inner contour of the magnet pot,
- arranging the coil carrier in the magnet pot, wherein the flange contour is arranged in a fashion recessed with respect to the seating surface, and
- at least sectionally filling the magnet pot with a filler material, wherein the flange contour provides a barrier for the filler material.

In accordance with a further manufacturing related aspect, these and other objects of the present disclosure are achieved by a method for manufacturing a magnetic coil for a magnetic actuator, particularly for an injector, the method comprising the following steps:

- providing a coil carrier comprising a tubular section and a collar which adjoins the tubular section, wherein the coil carrier is arranged for accommodating a coil winding,
- providing a die comprising a defined inner contour which is adapted to the coil carrier,
- inserting the coil carrier into the die, wherein the collar of the coil carrier is supported by a seating surface of the die,
- punching the collar with a punch, wherein a flange contour is formed at the collar, wherein an outline of the flange contour is defined by the inner contour of the die, and
- at least sectionally potting or overmolding the coil carrier with a filler material, wherein the flange contour provides a barrier for the filler material.

Exemplary aspects of the disclosure are based on the insight that the step of overmolding or potting may be combined with a punching procedure by means of which a highly-accurate sealing is enabled. After the punching, the flange contour exactly corresponds to the surrounding inner contour of the die. This is enabled without the necessity to satisfy excessively accurate manufacturing tolerances. Rather, the collar of the coil carrier may comprise an "excess extension" before the punching operation. After the punching, the resulting flange contour is adapted to the inner contour of the die in a highly-accurate fashion.

Hence, the collar of the coil carrier not only serves as a boundary for the coil winding received at the coil carrier. Further, the collar and/or the flange contour which is formed at the collar after the punching forms a tight sealing barrier for the filler material. Hence, the sealing for the overmolding or potting no longer has to be primarily provided by the corresponding molding tool which abuts the coil carrier at this side. Rather, now the flange contour serves as a "sealing element".

Needless to say, such an arrangement is primarily suited for manufacturing procedures wherein an overmolding with the filler material is performed at a relatively high pressure. In other words, pressure values may be present which generally occur in injection molding procedures for thermoplastic materials. Nevertheless, in the alternative, also a potting procedure is known, i.e. a filling with a fluid potting compound which is not exposed to an increased pressure or which is merely exposed to a slightly increased pressure. However, the increased sealing effect due to the integrated punching procedure may be on option also for these manufacturing steps.

In the context of the following explanations and elucidations of several arrangements and embodiments, reference is primarily made to the overmolding with fluid thermoplastics that are pressurized. However, this shall not be understood as limiting the scope.

The seating surface may be generally referred to as seating side. It is not necessarily required to provide an areal (flat) seating. The tubular section of the coil carrier may be also referred to as a section that is formed in a tube-like fashion. The tubular section may involve a closed cross-sectional profile. In accordance with alternative embodiments, the tubular section is at least sectionally provided with an open profile along the longitudinal extension or axial extension thereof. This may be the case for instance when a groove-like recess or a plurality thereof is formed at the tubular section. The recesses may serve for instance for preventing eddy current-related losses.

Also the coil carrier, particularly the collar thereof, at which the flange contour is formed by the punching procedure, is generally made from a plastic material, particularly by injection molding. The die is generally made from metal materials. Hence, in the punching operation, a cutting or shearing off of the "overhang" of the collar may be performed in a simple fashion in such a way that the then remaining flange contour is adapted to the inner contour of the die in a highly-accurate fashion. It goes without saying that embodiments of the method may be envisaged wherein the step of punching at least partially also involves a flow and/or a flow plastic deformation of the material of the coil carrier, for instance due to friction which involves a temperature increase in the area of a punching edge. However, insofar as reference is made to punching within the context of this disclosure, also embodiments of that kind shall be covered. It is essential that a separating procedure or cutting procedure is involved and that a remainder of the collar is present after the punching which is separated from the resulting flange contour. It may be envisaged that annular or at least ring segment-shaped scrap pieces are formed by the punching of the collar. The scrap pieces may be also referred to as punching slugs.

The punch used for the punching operation is generally adapted to the inner contour of the die. However, it is not necessary that the punch is adapted to the inner contour in such a highly-accurate fashion as it would be the case in an injection molding tool which would have to ensure the required sealing for the overmolding without the provision of a flange contour formed by punching in a highly-accurate fashion.

Even in cases when for instance an outer contour of the punch which is adapted to the inner contour of the die is offset from the inner contour in such a way that a sufficiently large play is present, the tight fitting flange contour may be formed in a highly-accurate fashion and at a great reproducibility.

According to an exemplary embodiment, the die is arranged as a magnet pot and provided with an annular or ring segment-shaped circumferential section which surrounds the inner contour and forms the seating surface or seating side, wherein the coil carrier remains in the magnet pot after the punching procedure. In other words, the magnet pot itself forms the die or punching die. Hence, a part of the punching tool is provided by the magnetic actuator itself, namely by the magnet pot. This enables a highly-efficient manufacturing. As the magnet pot itself defines the inner contour, the flange contour of the coil carrier which is formed by the punching procedure is always adapted to the magnet pot in a highly-accurate fashion. Excess molding material (flash material) and/or undesired residues of the filler material may be avoided in a high probability fashion. The coil carrier that is provided with the coil winding is permanently bonded with the magnet pot by the overmolding procedure.

According to a further embodiment of the method, the flange contour is arranged in a fashion recessed with respect to the seating surface after the punching. In an exemplary embodiment, the flange contour and/or also the coil carrier remain after the overmolding in this state. Due to the recessed arrangement, an offset between a frontal surface of the flange contour and the seating surface is provided. This may be for instance a design goal for the magnetic coil so as to ensure the functional safety of the magnetic actuator. For instance, the recessed arrangement of the flange contour may ensure that the armature may always abut the seating surface and not the flange contour, provided that the flange contour would extend beyond the seating surface. At least the probability of defective parts of that kind may be significantly reduced.

According to a further embodiment, the potting or overmolding involves a feeding of the filler material from a feeding side which faces away from a collar side of the coil carrier defined by the collar, wherein the barrier that is provided by the flange contour ensures a sealing of the filler material. Hence, the flange contour seals off the to-be-filled and/or to-be-overmolded space and prevents a transfer and/or an over-filling of the filler material to the side of the flange contour at which for instance the punch engages the collar of the coil carrier in the punching step.

According to a further embodiment, the method involves an overmolding of the coil carrier which is provided with the coil winding with a thermoplastic material. In an exemplary embodiment, the overmolding is performed with the material from which also the coil carrier is made. The thermoplastic material may be for instance polyphenylene sulfide (PPS). Alternative materials are for instance polyamide (PA), polyoxymethylene (POM) and similar thermoplastics. For instance, polyphenylene sulfide is high-temperature resistant and sufficiently media-resistant. In an exemplary embodiment, the coil carrier and the filler material for the overmolding are formed from the same material. In this way, a material interoperability may be improved. There is no huge likelihood of a different swelling behavior, temperature behavior, and such like. Overall, the coil carrier and the molding compound thus basically have the same characteristics which may further increase the lifespan, the robustness and the operational safety of the magnetic coil.

According to a further embodiment, the method further comprises providing a hold-down device for the potting or overmolding of the coil carrier, wherein the hold-down device is adapted to the inner contour of the die. In an exemplary embodiment, the hold-down device comprises a defined offset with respect to the inner contour. The hold-down device forms a part of the injection molding tool for overmolding of the coil carrier. However, as the coil carrier itself, due to the flange contour, ensures a sealing during the overmolding, the hold-down device merely has to provide a reduced accuracy. Rather, the hold-down device may comprise a frontal surface which is deliberately arranged and defined to be smaller than the inner contour of the die. This does not involve adverse effects on the sealing as the barrier function is ensured by the flange contour. It is sufficient to design the hold-down device in a sufficiently accurate fashion so as to prevent that the flange contour is excessively deformed during the overmolding procedure, due to the molding pressure. This may be however ensured by a hold-down device which is not adapted to the inner contour in a highly-accurate fashion. As the hold-down device provides a sufficiently large offset and/or a sufficiently large play with respect to the inner contour of the die and/or the magnet pot, only little wear occurs. Hence, the hold-down device may have a very long service life.

According to a further embodiment of the method, there is further provided forming a defined cutting edge at the die. The cutting edge may be arranged as a circumferential cutting edge and may surround the inner contour of the die. The cutting edge may be formed at a transition between the inner contour and the seating surface. Nevertheless, the cutting edge does not have in each case to be arranged in a completely circumferential (interruption-free circumferential) fashion. In an exemplary embodiment, the cutting edge comprises a defined sharp-edged form. In other words, the cutting edge may be arranged in a burr-containing or edge-containing fashion. However, as the coil carrier is made from a sufficiently soft thermoplastic material, there are no excessively high requirements for the cutting edge. It is further noted that the cutting edge of the die that is arranged as a magnet pot is only once used for cutting or punching in the manufacturing procedure for the magnetic coil. Hence, wear-related aspects do not play a considerable role.

According to a further embodiment of the method, there is further provided a counter holder for accommodating the coil carrier. In an exemplary embodiment, the counter holder defines the position of the coil carrier in the die. The counter holder may be for instance referred to and arranged as a support bolt. Generally, the counter holder may form part of the magnet pot. It may be however also envisaged to use a separate counter holder. The counter holder may be arranged for guiding the coil carrier when the same is inserted in the die and/or the magnet pot and, eventually, processed by the step of punching. In an exemplary embodiment, the counter holder may define the actual position of the coil carrier in the die which involves also the offset of the flange contour and/or of the frontal surface thereof with respect to the seating surface of the magnet pot. Generally, the magnet pot may comprise a tubular outer wall and a tubular inner wall between which the coil carrier is arranged that is provided with the coil winding. In this respect, the inner wall of the magnet pot may form the counter holder.

According to a further embodiment of the method, there is further provided forming an undercut contour at the coil carrier, particularly forming at least one undercut opening at the collar of the coil carrier, wherein the step of potting or overmolding the coil carrier involves a penetration of the filler material into the undercut contour. In this way, the filler material may be joined with the coil carrier after the overmolding in a positive fit and bonded fashion. As a result, a high-strength compound of the coil carrier and the filler material may be present. For instance, the undercut contour may involve dip holes or stepped recesses which are tapered in a direction towards the side of the collar at which the coil winding is received. During the overmolding procedure, the hold-down device may abut the collar and/or the flange contour of the coil carrier in an areal fashion in such a way that the filler material may penetrate into the undercut contour, wherein, due to the areal contact, the likelihood of excess molding material or residual material is significantly reduced. The hold-down device may completely cover the undercut contour which may be ensured in spite of the deliberately play-involving arrangement of the hold-down device in relation to the inner contour.

According to a further embodiment of the method, there is further provided a position securing section at the inner contour of the die, wherein the formed flange contour provides a rotation orientation feature in such a way that the coil carrier is arranged to be coupled with the die in a fashion fixed against rotation. Both the magnet pot and the coil carrier that is provided with the coil winding may be arranged in a basically rotationally symmetric fashion and/or may comprise rotationally symmetric sections. However, a defined angular orientation between the coil carrier and the magnet pot may be necessary. This applies for instance in regard of a contacting of the coil winding. Generally, this arrangement may also serve as a mounting aid. For instance, the flange contour may comprise radially protruding lugs which are arranged to engage respective recesses at the seating surface. Also the rotation orientation feature at the flange contour may be simply formed by the step of punching when the die, particularly the die that is arranged as a magnet pot, provides a counter contour, namely the at least one position securing section.

An arrangement involving a punched flange contour is that more complex mating geometries may be provided within the context of the present disclosure. Generally, the flange contour may comprise a plurality of design elements, provided that they may be reflected by a "negative" at the magnet pot. This may for instance involve positive and negative radii and edges, and similar transitions. The flange contour does not necessarily have to be arranged in a circular fashion and may nevertheless ensure a sufficient sealing.

According to a further embodiment of the method, the coil carrier further comprises an opposite flange which is arranged at an end of the tubular section facing away from the collar, wherein the coil winding is arranged between the collar and the opposite flange. In contrast to the flange contour, the opposite flange is, however, not arranged as a sealing opposite flange. This is necessary so as to enable the desired injection of the filler material in the intermediate space between the flange contour and the opposite contour. Put simply, the coil carrier may be arranged as a rotation body or a nearly rotation body comprising a C-shaped rotational cross-section. Between outer legs of the C, the coil winding is received.

In regard of the magnetic coil, these above and other objects of the disclosure are achieved by a magnetic coil for a magnetic actuator, particularly for an injector, wherein the magnetic coil comprises:

- a coil carrier comprising a tubular section and a collar which adjoins the tubular section,
- a coil winding which is arranged at the coil carrier,
- a die arranged as a magnet pot, particularly a punching die, and
- filler material which at least sectionally surrounds the coil winding as a potting or overmolding material,
- wherein the coil carrier is received in the die,
- wherein a punched flange contour is provided at the collar of the coil carrier, and
- wherein the flange contour is arranged as a barrier for the filler material and particularly seals a transition area extending between the inner contour of the die and the outline of the flange contour.

In an exemplary embodiment, the magnetic coil is manufactured in accordance with at least some aspects of the above-described manufacturing method.

According to a refinement of the magnetic coil, at least one undercut contour is formed at the coil carrier, for instance at the collar of the coil carrier, wherein the undercut contour is facing away from the coil winding and at least partially filled with the filler material.

According to a further embodiment of the magnetic coil, the die comprises at least one position securing section arranged at a front end, wherein at least one rotation orientation feature is formed at the collar of the coil carrier which is coupled with the at least one position securing section.

In an exemplary embodiment, a magnetic coil in accordance with one of the afore-mentioned aspects is used in a magnetic actuator which forms part of an injector, for instance a part of a fuel injector nozzle for a combustion engine.

It is understood that the above-mentioned features of the disclosure and those to be explained in the following can be applied, not only in the respective specified combination, but also in other combinations or singly, without departing from the scope of the present disclosure.

BRIEF DESCRIPTION OF THE DRAWINGS

Further features and advantages of the disclosure are disclosed by the following description of a plurality of exemplary embodiments, with reference to the drawings, wherein.

DETAILED DESCRIPTION OF EXEMPLARY EMBODIMENTS

Figure 1:
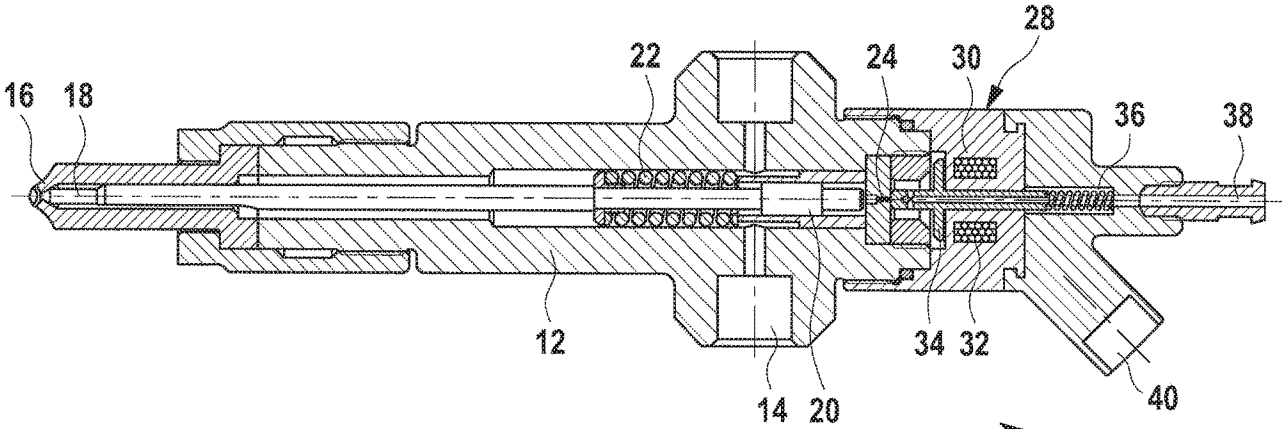
FIG. 1 is a longitudinal cross-section of an exemplary embodiment of an injector.

FIG. 1 shows a longitudinal cross-sectional view of an exemplary arrangement of an injector 10. The arrangement of the injector 10 is merely having an exemplary character and shall be provided herein primarily as a representative of a plurality of further embodiments that may be envisaged. The injector 10 comprises a housing 12. The housing 12 is provided with a connector 14 by which fuel or propellant may be provided. A nozzle-side end of the injector 10 is provided with a valve nozzle 16. Further, a nozzle needle 18 is arranged at the housing 12 by which the injection volume may be controlled. The nozzle needle 18 is coupled with a control piston 20 which is biased by a closing spring 22 towards a closing position. At an end of the control piston 20 that is facing away from the valve nozzle 16, a control bore 24 is formed, wherein an electromagnetic actuator adjoins the control bore 24. The actuator 28 comprises a magnetic coil 30 which is provided with a coil winding 32. Further, an armature 24 is assigned to the actuator 28, wherein the armature 24 is biased by a spring 36 towards a rest position. By activating the actuator 28, the armature 34 may be pulled and/or lifted. At the end thereof that is facing away from the valve nozzle 16, the housing 12 comprises a reflow connector 38 through which excess fuel may be released. Further, a control connector 40 is provided through which the electromagnetic actuator 28 may be controlled by selectively energizing the coil winding 32.

Further embodiments of injectors may be readily envisaged. Regularly, the injectors 10 are provided with an actuator 28 which is frequently arranged as an electromagnetic actuator 28 and provided with a coil winding 32. The coil winding 32 is regularly overmolded and/or potted. In this way, the coil winding 32 may be efficiently protected against environmental influences.

With reference to the exemplary embodiments explained in more detail further below, exemplary arrangements and embodiments of magnetic coils 30 for electromagnetic actuators 28 of that kind and exemplary method aspects for the manufacturing thereof will be elucidated and described in more detail.

Figure 2:
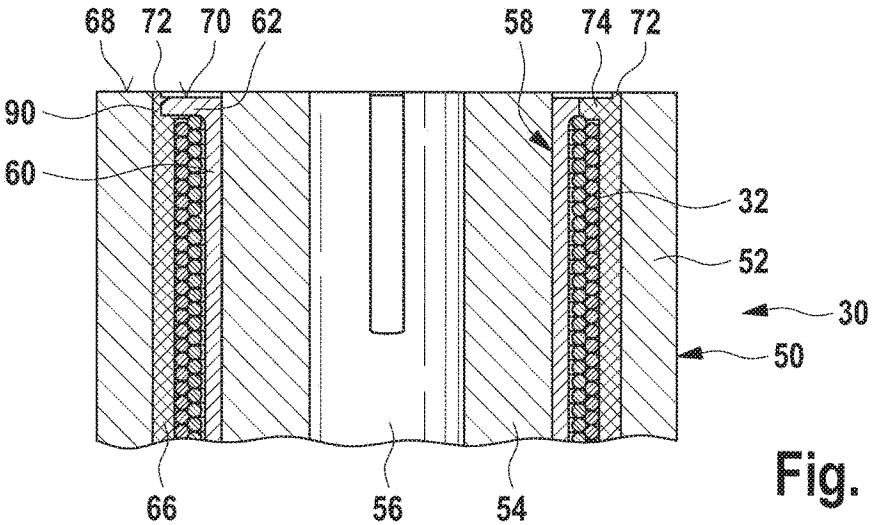
FIG. 2 is a partial view of a longitudinal cross-section of a magnetic coil for a magnetic actuator which may be used in an injector.

FIG. 2 shows a cross-sectional partial view of a magnetic coil 30. The magnetic coil 30 is provided with a coil winding 32. Further, the magnetic coil 30 comprises a magnet pot 50 comprising an at least sectionally circumferential outer wall 52 and an at least sectionally circumferential inner wall 54. The magnet pot 50 may be generally also referred to as yoke. In the magnet pot 50, a guide 56 is formed (not shown in FIG. 2). The guide 56 may be arranged as a guide for an armature or for a spring that is coupled with the armature.

Generally, the magnet pot 50 is made from a ferrous material or a ferrous-containing material. The coil winding 32 is received at a coil carrier 58. The coil carrier 58 simplifies the manufacturing, particularly the formation of the coil winding 32. The coil carrier 58 may be for instance arranged as an injection molded part, for instance from a thermoplastic material, such as polyphenylene sulfide (PPS). By way of example, the coil carrier 58 comprises a tubular section 60 wherein a collar 62 is arranged at an end thereof, wherein the collar 62 is radially outwardly extending as a circumferential collar. In a non-assembled state of the coil carrier 58, the tubular section 60 delimits or surrounds an opening 64, refer also to FIG. 3.

It can be further seen from the exemplary embodiment of FIG. 2 that, at least in a finally assembled state, a filler material 66 is disposed in eventual clearances or gaps between the outer wall 52 of the magnet pot 50 and the coil carrier 58. In this way, the coil winding 32 may be at least sectionally overmolded or potted and thus protected against damaging. Further, the filler material 66 ensures a reliable connection and position fixation between the coil carrier 58 and the magnet pot 50.

The magnet pot 50 comprises a seating surface 68 which is for instance arranged as a contact surface for an associated magnet armature. Nevertheless, embodiments may be envisaged wherein, by design measures, a remaining air gap is provided between the seating surface and the magnet armature. At the collar 62 of the coil carrier 58, a frontal surface 70 is formed. A design goal for the magnetic coil 30 may involve that the frontal surface 70 of the coil carrier 58 is deliberately recessed with respect to the seating surface 68 so as to ensure that no filler material 66 may protrude. Such an arrangement namely might involve adverse effects on the function of an actuator that is provided with the magnetic coil 30. In a transition area 90 between the collar 62 and the magnet pot 50, particularly the outer wall 52 thereof, occasionally there may be excess molding material or flash protrusions 72. A reason for this is often that the collar 62 cannot be adapted to the magnet pot 50 in a highly-accurate and sealing fashion. However, as for instance the overmolding of the coil winding 32 with the filler material 66 is performed at an increased pressure, filler material 66 may enter the transition area 90 and/or may extend through the transition area 90. The axial flush protrusions 72 which potentially may occur may have the result that the respective instant of the magnetic coil 30 is classified as junk. An offset and/or a deliberate recess of the coil carrier 58 with respect to the seating surface 68 is also an option when a remaining air gap is provided as a design measure so as to ensure the operational safety.

FIG. 2 further shows that also design elements may be deliberately provided, at which filler material 66 shall penetrate in the area of the collar 62. In FIG. 2, a lug which is formed by the filler material 66 is designated by 74, wherein the lug 74 may provide a position securing or rotation orientation feature. To this end, a respective recess is provided at the collar 62 into which the filler material 66 may penetrate. However, also in the area of the lug 74, excess molding material and/or protrusions 72 may be present which is basically undesired.

Figure 3:
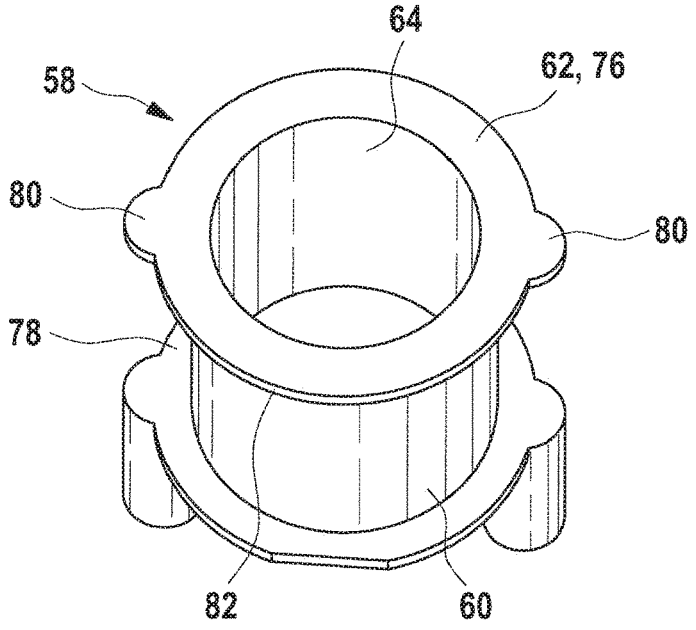
FIG. 3 is a perspective top view of a coil carrier for a magnetic coil.
Figure 4:
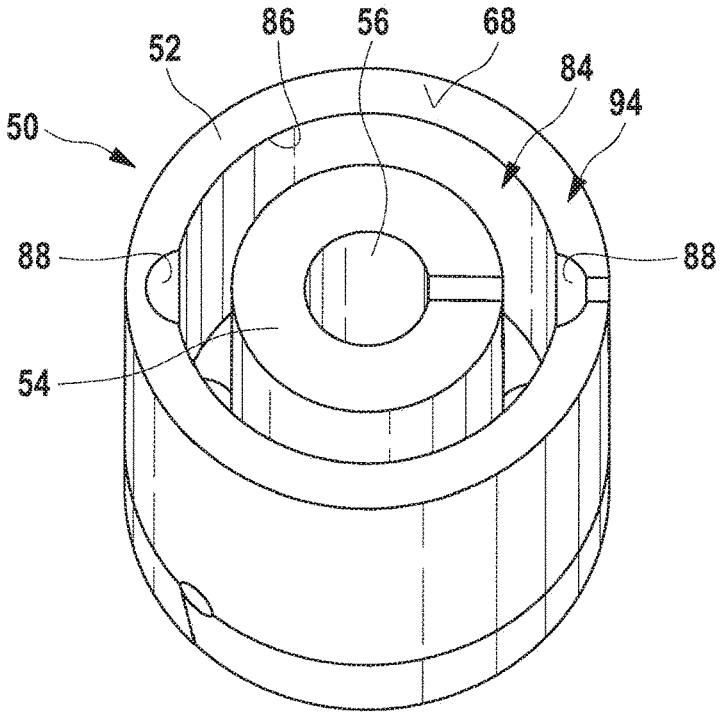
FIG. 4 is a perspective top view of a magnet pot for a magnetic coil, wherein the magnet pot is arranged for accommodating the coil carrier according to FIG. 3.

In the following, several embodiments will be elucidated which address this issue and which propose respective solutions therefor. FIG. 3 and FIG. 4 illustrate perspective views of a coil carrier 58 (FIG. 3) and a magnet pot 50 (FIG. 4) which are basically arranged in a fashion similar to the components shown in FIG. 2.

The coil carrier 58 illustrated in FIG. 3 is generally arranged similar to a cable drum and, as already described above, provided with a central tubular section 60 which defines an opening 64. At a first end of the tubular section 60, a collar 62 is formed. Based on the collar 62, a flange contour 76 may be formed as will be discussed further below. At the end of the tubular section 60 which is facing away from the collar 62 and/or the flange contour 76, an opposite flange 78 is formed. Between the flange contour 76 and the opposite flange 78, a coil winding 72 may be arranged (not shown in FIG. 3). At the flange contour 76, rotation orientation feature elements 80 are formed which are for instance arranged as radially protruding lugs. In the alternative, an arrangement with corresponding recesses at the flange contour 76 may be envisaged. At an outer circumference of the flange contour 76, an outline 82 is formed.

The magnet pot 50 illustrated in FIG. 4 comprises a defined inner contour 84. In an exemplary embodiment, the flange contour 76 of the coil carrier 58 is adapted to the inner contour 84 of the magnet pot 50 in a highly-accurate fashion. This may be effected by forming the flange contour 76 and/or the outline 82 thereof by bringing an originally larger collar 62 in such a way into contact with a punching edge or cutting edge 86, that is formed at the magnet pot 50, that a punching procedure and/or a punching of the flange contour 76 is enabled. This may of course also involve a formation of the rotation orientation feature elements 80, provided that respective counter elements are formed at the magnet pot 50 which may be for instance referred to as position securing sections 88. In other words, the outline 82 of the flange contour 76 substantially corresponds to the shape of the cutting edge 86 of the magnet pot 50. Accordingly, the flange contour 76 may engage the inner contour 84 of the magnet pot 50 in a sealing fashion. This may significantly reduce the likelihood of excess molding material or protrusions during the potting or overmolding procedure with the filler material 66. It goes without saying that FIG. 3 illustrates a state of the coil carrier 58 which may be present only after the coil carrier 58 has been brought into contact with the magnet pot in such a way that a stamping procedure at the collar 62 may be performed.

In other words, a die 94 for the punching of the flange contour 76 is provided which is provided by the magnet pot 50 itself. This ensures in any case that a nearly perfect free-of-play adaptation of the flange contour 76 to the inner contour 84 may be accomplished. In this way, gaps in the transition area 90 (refer also to FIG. 2) may be entirely or nearly entirely avoided so that the likelihood of the filler material 66 passing over may be further reduced.

Figure 5:
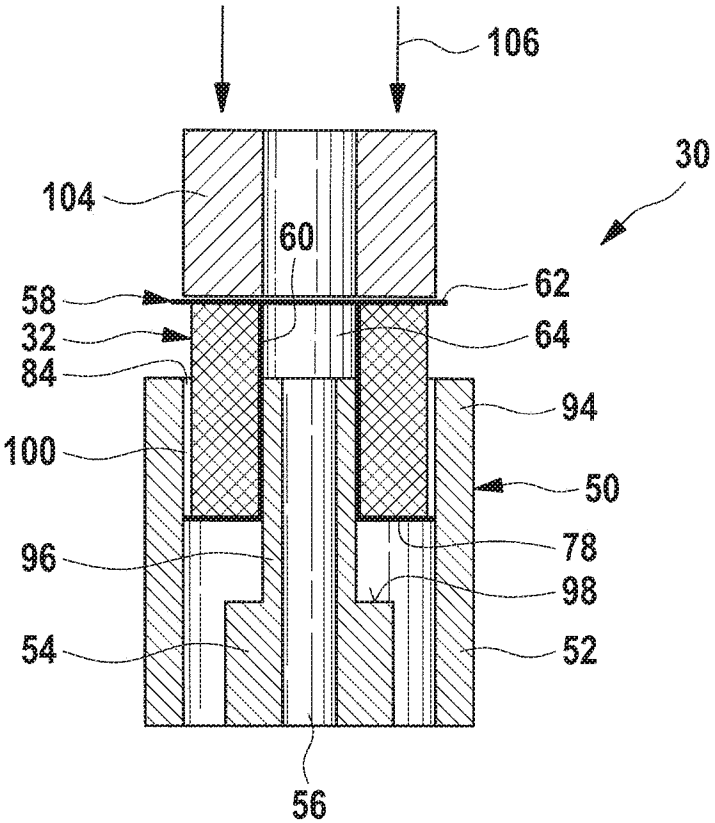
FIG. 5 is a schematic, greatly simplified view of a manufacturing step of the production of a magnetic coil, wherein a coil carrier is inserted in a magnet pot.

With reference to FIGS. 5 to 8, several steps of a manufacturing method by which such a punched flange contour 76 may be produced will be illustrated. FIG. 5 elucidates a state in which a coil carrier 58 that is provided with a coil winding 32 is inserted in an annular opening of a magnet pot 50. The coil carrier 58 is shown in FIGS. 5 to 8 in a greatly simplified fashion but may, however, basically correspond to the coil carrier 58 in accordance with FIG. 3. The same basically applies to the magnet pot 50 which may basically correspond to the arrangement according to FIG. 4.

In accordance with the embodiment elucidated with reference to FIGS. 5 to 8, the coil carrier 58 may be guided at its opening 64 by a bolt 96. The bolt 96 may be for instance formed by the inner wall 54 of the magnet pot 50. The bolt 96 may ensure a coaxial alignment between the coil carrier 58 and the magnet pot 50. A seat 98 may adjoin the bolt 96, wherein the seat 98 defines an axial limit stop for the coil carrier 58. In the states in accordance with FIGS. 5 and 6, the coil carrier 58 however does not yet come into an abutment at the seat 98. This is, however, the case in the states shown in the FIGS. 7 and 8.

Figure 6:
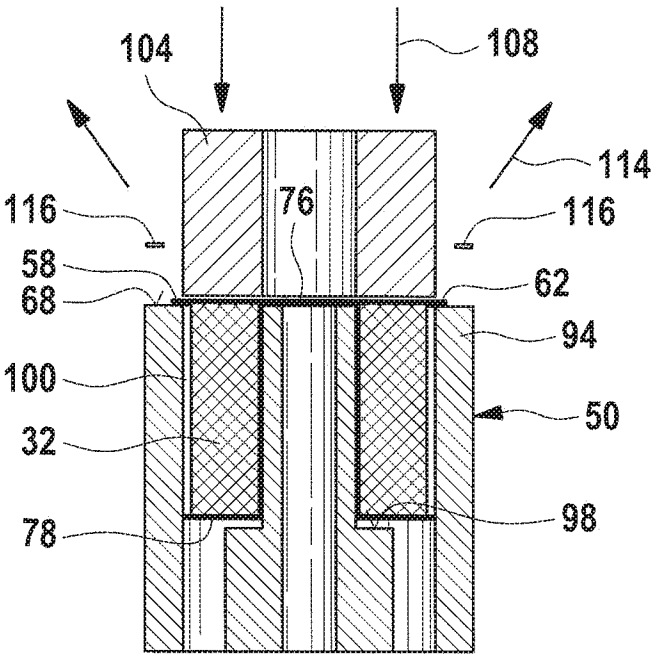
FIG. 6 is a schematic, greatly simplified view of the arrangement of FIG. 5, wherein a collar of the coil carrier is processed in a punching procedure, in which the magnet pot itself serves as a die.

In combination, it can be seen in FIGS. 5 and 6 that the collar 62 of the coil carrier 58 initially basically comprises an "excess extension" with respect to the inner contour 84 of the magnet pot 50. This is exemplarily shown in the state in accordance with FIG. 6 in which the collar 62 abuts and/or rests on the seating surface 68 of the magnet pot 50.

Further, in FIGS. 5 and 6 a punch 104 is indicated in a schematic, greatly simplified fashion. The punch may be also referred to as stamping punch. Arrows designated by 106 indicate a feed direction for the coil carrier 58 and the punch 104. The state according to FIG. 6 is followed by a stamping procedure, wherein the punch 104 further acts on the collar 62, even though the collar 62 already rests on the seating surface 68, refer also to arrows designated by 108 which indicate a stamping direction or a direction of a stamping force.

In an exemplary embodiment, the magnet pot 50 itself is arranged as die or punching die 94. By the stamping procedure, a flange contour 76 is formed at the collar 62 the shape of which is basically defined by the application of the magnet pot 50 as a die 94. As a result, at least a portion of the collar 62 is disconnected and/or separated, refer for instance to scrap elements 116 indicated in FIG. 6 which may be also referred to as punching slugs. Ideally, after the punching procedure, an annular or at least a ring segment-shaped scrap piece 116 remains. Arrows indicated by 114 elucidate a lead-away movement for the scrap pieces 116. Further, the punch 104 may still act on the coil carrier 58 so as to bring the opposite flange 78 thereof which is arranged at an end of the coil carrier 58 which is facing away from the collar 62 into an abutment at the seat 98.

It goes without saying that the coil carrier 58 does not necessarily have to be moved by the punch 104 itself further towards the seat 98. This displacement may be also effected by another punch or hold-down device.

Figure 7:
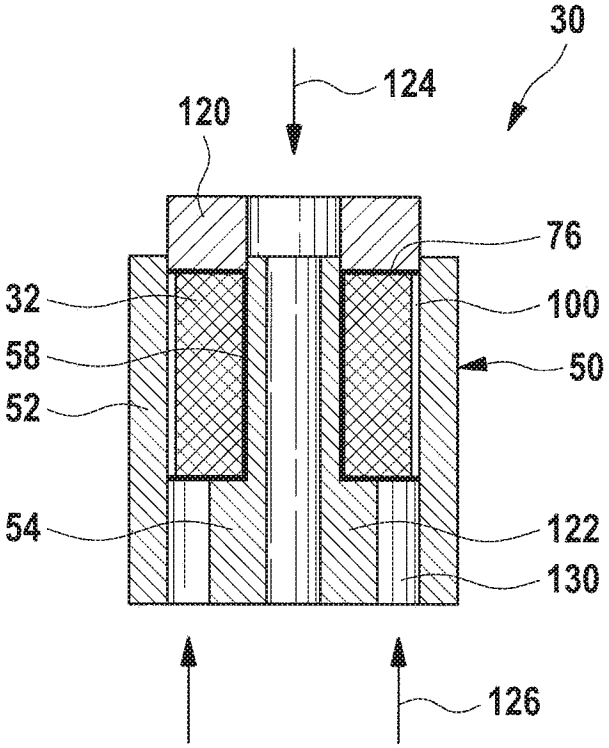
FIG. 7 is a schematic, greatly simplified view of the arrangement of FIG. 6, illustrating an overmolding of components of the arrangement.

FIG. 7 elucidates a state in which the coil carrier 58 which is provided with the sealing flange contour 76 assumes an end position with respect to the magnet pot 50. An axial position of the coil carrier 58 is defined by the seat 98. Now, a hold-down device 120 may approach the flange contour 76. The hold-down device 120 may be referred to as a component of an injection molding tool for an overmolding procedure. A feed direction for a hold-down device 120 is indicated in FIG. 7 by 124. The hold-down device 120 urges the coil carrier 58 against a counter holder 122 which may be defined, as already indicated above, by the bolt 96 and the seat 98. In an exemplary embodiment, the inner wall 54 of the magnet pot 50 forms the counter holder 122. However, there may be also embodiments envisaged, wherein separate counter holders 122 are utilized which do not form a permanent portion of the to-be-manufactured magnetic coil 30.

In the FIGS. 5, 6, 7 and 8, a respective gap 100 is indicated which is formed between the outer wall 52 of the magnet pot 50 and the coil winding 32. In an exemplary embodiment, a goal of the potting and/or overmolding is to completely fill this gap 100 with filler material 66, refer also to FIG. 8. This, however, may involve that no filler material flows beyond the flange contour 76 which would result in excess material protrusions. This state shall be avoided in accordance with an exemplary embodiment.

In FIG. 7, arrows designated by 126 illustrate an insertion of or overmolding with a fluid filler material 66, for instance with a thermoplastic material. In an exemplary embodiment, polyphenylene sulfide (PPS) is used to this end. The opposite flange 78 of the coil carrier 58 is small enough so that filler material 66 may flow by so as to fill the gap 100. Due to the not insignificant injection pressure at which the filler material 66 is injected, it may be recommendable to support and/or back the flange contour 76 with the hold-down device 120. Hence, the hold-down device 120 primarily provides a counter force which prevents excessive deformations of the flange contour 76. However, the hold-down device 120 is not intended for sealing the magnet pot 50 in such a way that no filler materials 66 may flow beyond the flange contour. This is primarily achieved by the sealing effect of the flange contour 76 itself.

Figure 8:
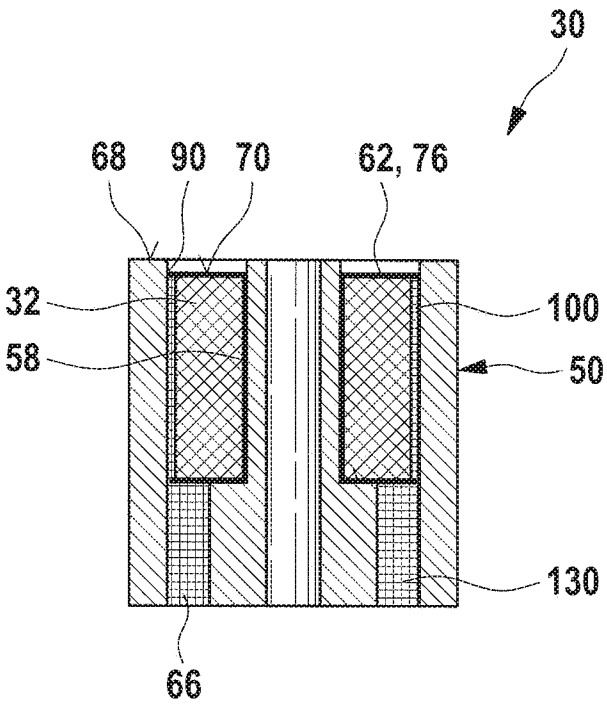
FIG. 8 is a schematic, greatly simplified cross-sectional view of the arrangement of FIG. 7 after the overmolding procedure.

Generally, the potting or overmolding may involve a filling or a displacement of an empty filling volume 130. FIG. 8 shows a final state of the magnetic coil 30, wherein the filling volume 130 and/or the gap 100 is entirely filled with the filler material 66. It goes without saying that for instance a contacting of the coil winding 32 may be routed through the filler material 66 to the exterior so as to contact the coil winding 32.

Figure 9:
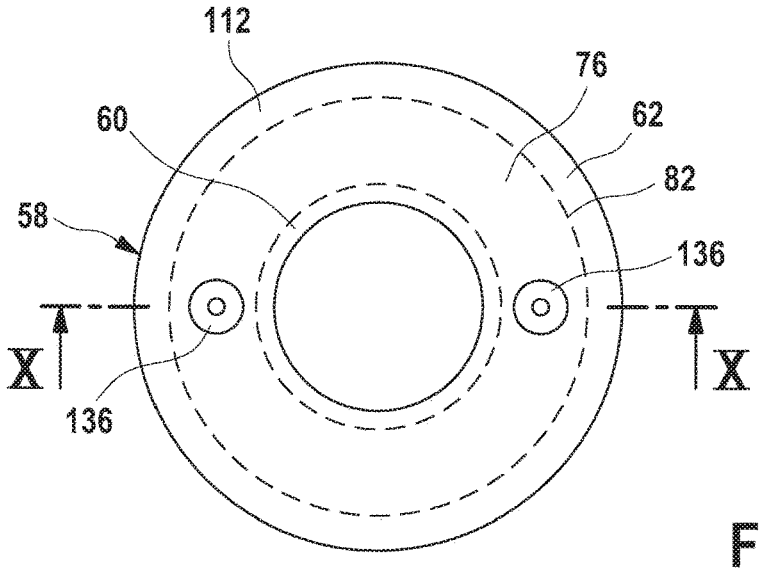
FIG. 9 is a schematic, greatly simplified top view of a collar of a coil carrier in which an undercut contour is formed.
Figure 10:
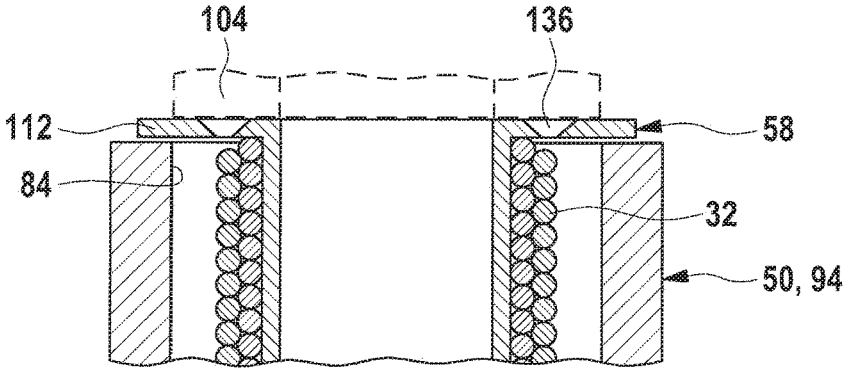
FIG. 10 is a partial cross-sectional view of the coil carrier of FIG. 9 along the line X-X, wherein the coil carrier is inserted in a magnet pot.
Figure 11:
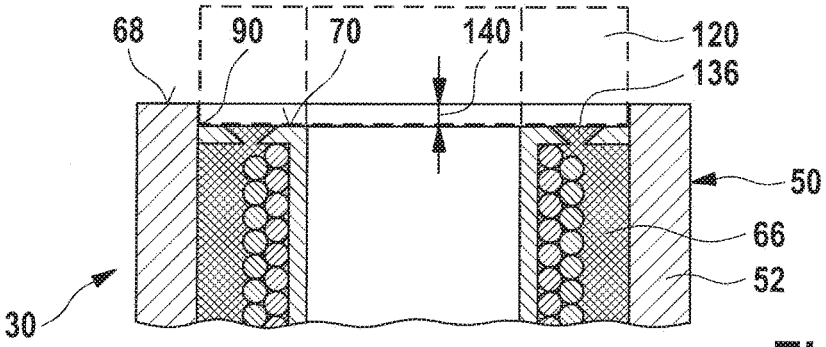
FIG. 11 is a further partial cross-sectional view of the arrangement of FIG. 10, wherein an overmolding is performed and a compound of the coil carrier and the magnet pot is formed.

With reference to FIGS. 9, 10 and 11, a further exemplary embodiment will be elucidated. FIG. 9 illustrates a top view of a collar 62 of a coil carrier 58. At the collar 62 a flange contour 76 is indicated by a dashed line 82. The flange contour 76 would result from a stamping procedure when inserting the coil carrier 58 into a magnet pot 50, refer also to FIG. 10. Hence, after the punching procedure, an annular scrap 112 would remain. An outline 82 of the then resulting flange contour 76 corresponds then to the inner contour 84 of a die 94 that is provided by the magnet pot 50. The punching procedure for forming the flange contour 76 is elucidated in FIG. 10 which illustrates a partial cross-section of the coil carrier 58 according to FIG. 9 along the line X-X in FIG. 9. In FIG. 10, further the magnet pot 50 that forms the die 94 is at least partially shown. A punch 104 is indicated in FIG. 10 merely by dashed lines.

According to the embodiments elucidated with reference to FIGS. 9, 10 and 11, further at least one undercut contour 136 is formed at the collar 62 and/or at the resulting flange contour 76. In the provided example, two undercut contours 136 are provided which are arranged in a basically screw hole fashion and which are tapered in a direction towards the coil winding 32.

In the overmolded and/or potted state illustrated with reference to FIG. 11, the filler material 66 may penetrate into the undercut contour 136. As a result, after the filler material 66 solidifies, both a bonding connection as well as a positive fit connection between the filler material 66 and the coil carrier 58 is provided.

By means of a hold-down device 120 which is indicated by dashed lines in FIG. 11, the flange contour 76 may be supported and/or backed during the overmolding procedure. In an exemplary embodiment, the hold-down device 120 rests on the undercut contour 136 in an areal (surface-contact) fashion, when the filler material 66 is injected. In this way, a flow by and/or the formation of excess bonding material may be efficiently avoided. In the transition area 90 between the flange contour 76 and the magnet pot 50 and/or the outer wall 52 thereof, a considerably great sealing effect is provided as the flange contour 76 is, due to the punching operation, exactly adapted to the inner contour 84 of the magnet pot 50. In FIG. 11, there is further indicated a deliberate offset 140 between a frontal surface 70 of the flange contour 76 and the seating surface 68 of the magnet pot 50. In this way, it may be ensured that the seating surface 68 which serves as a functional surface in the operation of the magnetic coil 60 is accessible for instance for an armature of an electromagnetic actuator implementing the magnetic coil 30.

Figure 12:
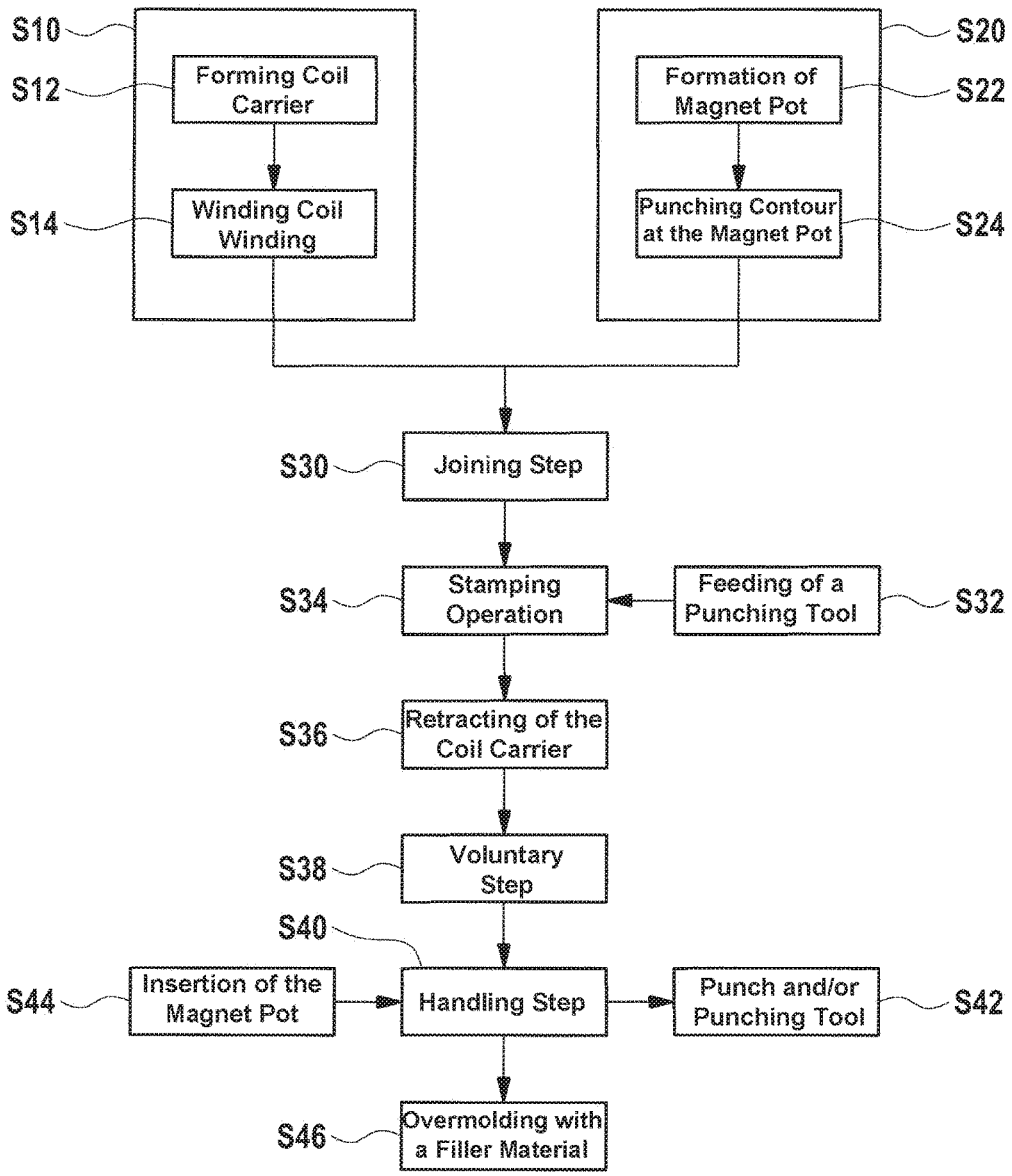
FIG. 12 is a schematic, greatly simplified block diagram illustrating an exemplary arrangement of a method for manufacturing a magnetic coil for a magnetic actuator.

FIG. 12 elucidates by means of a schematic, greatly simplified block diagram an exemplary arrangement of a method for manufacturing a magnetic coil for an electromagnetic actuator, which may be used as an injector of a combustion engine.

The method comprises a step S10 which involves a provision of a coil carrier. The step S10 may involve sub-steps S12, S14. The sub-step S12 involves forming the coil carrier by means of injection molding. The sub-step S14 may follow which involves a winding of a coil winding which is received at the coil carrier. The coil carrier further comprises a tubular section and a collar adjoining the tubular section.

A further step S20 of the method involves the provision of a magnet pot. In an exemplary embodiment, the magnet pot also serves as a die or punching die in the manufacturing of the magnetic coil. In an exemplary embodiment, the magnet pot is arranged for a single punching operation which relates to the coil carrier, particularly to the collar thereof. A sub-step S22 involves a formation of the magnet pot, for instance by an appropriate molding operation. This may for instance involve a casting operation, a sinter operation or a similar method. Further, a machining of the magnet pot may follow.

In a further sub-step S24, a punching contour at the magnet pot is provided. This may involve the formation of a defined cutting edge. The punching contour may be basically also already formed—so to say as a by-product—by the original formation of the magnet pot as such.

A step S30 follows the steps S10 and S20 which may be also referred to as joining step or pre-assembly step. The coil carrier that is provided with the coil winding is inserted into the magnet pot. In an exemplary embodiment, the collar of the coil carrier is too large for a receiving contour or inner contour of the magnet pot. In other words, the collar may rest on a front end of the magnet pot at a seating surface. Hence, the coil carrier is prepared for a punching operation. Before the actual stamping operation (step S34), a feeding of a punching tool, particularly of a punch, may be provided which is accomplished in a step S32. After the execution of the step S34, a flange contour is formed at the collar which is adapted to the inner contour of the magnet pot.

A subsequent step S36 involves a retraction of the coil carrier in the magnet pot. This is enabled as the collar which was originally too large, is adapted by the punching operation accordingly. The retracting step involves the formation of a desired offset dimension between the flange contour and a seating surface of the magnet pot.

A further step S38 may follow which may be however arranged as a voluntary or an optional step. The optional step S38 involves a deburring procedure or a brushing procedure by means of a deburring tool or a brushing tool. This may already take place at the pre-assembled arrangement of the magnet pot and the coil body. In the step S38, burrs and similar remainders at the cutting edge of the magnet pot may be removed, if necessary. Also any remainders of the coil carrier may be removed in this way. The deburring or brushing may involve a cleaning operation so as to remove any remaining particles.

By way of example, a handling step S40 may follow. In connection with the handling step S40, in a step S42, the punch and/or the punching tool may be lead away. A step S44 may involve an insertion of the magnet pot that is provided with the coil carrier into a molding tool. This may also involve the provision and an approaching of a hold-down device which approaches the flange contour so as to support the flange contour. In this way, a preparation for a further step S46 may be accomplished. The step S46 involves an overmolding or potting with a filler material, for instance with a fluid thermoplastic material. In an exemplary embodiment, the filler material is inserted by injection molding. This involves that the filler material is pressurized. The hold-down device protects the flange contour during the molding operation against excessive deformations. As the flange contour is adapted to the inner contour of the magnet pot in a highly-accurate fashion, there is no likelihood or only little likelihood of a transfer of filler material beyond the flange contour. The flange contour acts as a barrier for the filler material at the magnet pot.

What is claimed is:

1. A method of manufacturing a magnetic coil for a magnetic actuator, the method comprising the following steps:

providing a coil carrier comprising a tubular section and a collar, wherein the coil carrier is arranged for accommodating a coil winding, providing a magnet pot comprising a defined inner contour which is adapted to the coil carrier, inserting the coil carrier in the magnet pot, wherein the collar of the coil carrier rests on a seating surface of the magnet pot, punching the collar with a punch that cooperates with the magnet pot, wherein, at the collar, a flange contour is formed such that an outline is defined by the inner contour of the magnet pot, arranging the coil carrier in the magnet pot, wherein the flange contour is arranged in a fashion recessed with respect to the seating surface, and at least sectionally filling the magnet pot with a filler material, wherein the flange contour provides a barrier for the filler material.

2. The method according to claim 1, wherein the filler material is a thermoplastic material, and wherein the filler material is equivalent to material from which the coil carrier is made.

3. The method according to claim 1, further comprising forming an undercut contour at the collar of the coil carrier, wherein the step of at least sectionally filling the magnet pot involves a penetration of the filler material into the undercut contour.

4. A method of manufacturing a magnetic coil for a magnetic actuator, the method comprising the following steps:

providing a coil carrier comprising a tubular section and a collar which adjoins the tubular section, wherein the coil carrier is arranged for accommodating a coil winding, providing a die comprising a defined inner contour which is adapted to the coil carrier, inserting the coil carrier in the die, wherein the collar of the coil carrier rests on a seating surface of the die, punching the collar with a punch, wherein, at the collar, a flange contour is formed such that an outline is defined by the inner contour of the die, and at least sectionally filling the coil carrier with a filler material, wherein the flange contour provides a barrier for the filler material.

5. The method according to claim 4, wherein the die is arranged as a magnet pot and comprises a circumferential section which surrounds the inner contour and forms the seating surface, and wherein the coil carrier remains in the magnet pot after the punching of the collar.

6. The method according to claim 4, wherein, after the punching of the collar, the flange contour is arranged in a fashion recessed with respect to the seating surface.

7. The method according to claim 4, wherein the step of at least sectionally filling the coil carrier involves feeding the filler material from a feeding side which is facing away from a collar side of the coil carrier defined by the collar, and wherein the barrier provided by the flange contour provides a sealing for the filler material.

8. The method according to claim 4, wherein the step of at least sectionally filling the coil carrier involves an overmolding, with a thermoplastic material, of the coil carrier that is provided with the coil winding.

9. The method according to claim 8, wherein the thermoplastic material for overmolding the coil carrier is equivalent to a material from which the coil carrier is made.

10. The method according to claim 4, further comprising providing a hold-down device for the at least sectionally filling of the coil carrier, wherein the hold-down device contacts the collar, and wherein the hold-down device is adapted to the inner contour of the die and comprises a defined offset with respect to the inner contour of the die.

11. The method according to claim 4, further comprising forming a defined cutting edge at the die.

12. The method according to claim 4, further comprising providing a counter holder for accommodating the coil carrier in the die, wherein the counter holder defines a position of the coil carrier in the die.

13. The method according to claim 4, further comprising forming an undercut contour at the coil carrier.

14. The method according to claim 4, wherein an undercut contour involves at least one undercut opening at the collar of the coil carrier, and wherein the step of at least sectionally the coil carrier involves a penetration of the filler material into the undercut contour.

15. The method according to claim 4, further comprising providing a position securing section at the inner contour of the die, wherein the formed flange contour provides for a rotation orientation in such a way that the coil carrier is arranged to be coupled with the die in a fashion fixed against rotation.

16. The method according to claim 4, wherein the coil carrier further comprises an opposite flange arranged at an end of the tubular section facing away from the collar, and wherein the coil winding is arranged between the collar and the opposite flange.

* * * * *